US009984613B2

(12) United States Patent
Suzuki

(10) Patent No.: US 9,984,613 B2
(45) Date of Patent: May 29, 2018

(54) SUBSTRATE AND DISPLAY APPARATUS

(71) Applicant: CANON KABUSHIKI KAISHA, Tokyo (JP)

(72) Inventor: Yasuo Suzuki, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 39 days.

(21) Appl. No.: 15/156,510

(22) Filed: May 17, 2016

(65) Prior Publication Data

US 2016/0351108 A1 Dec. 1, 2016

(30) Foreign Application Priority Data

May 27, 2015 (JP) ..... 2015-107066

(51) Int. Cl.
*G09G 3/20* (2006.01)
*G09G 5/00* (2006.01)

(52) U.S. Cl.
CPC ..... *G09G 3/2092* (2013.01); *G09G 5/006* (2013.01); *G09G 2310/08* (2013.01); *G09G 2370/08* (2013.01); *G09G 2370/12* (2013.01)

(58) Field of Classification Search
CPC ..... G09G 2310/08; G09G 2370/08
USPC ..... 345/501, 505
See application file for complete search history.

(56) References Cited

U.S. PATENT DOCUMENTS

2010/0164570 A1* 7/2010 Priego ..... H02M 3/1584 327/157
2011/0119475 A1* 5/2011 Chen ..... G06F 1/08 713/2
2016/0267213 A1* 9/2016 Maeda ..... G06F 17/5081

FOREIGN PATENT DOCUMENTS

JP 2003332997 A 11/2003
JP 2008216606 A 9/2008

* cited by examiner

*Primary Examiner* — Jacinta M Crawford
(74) *Attorney, Agent, or Firm* — Rossi, Kimms & McDowell LLP

(57) ABSTRACT

A substrate includes first and second image processing circuits performing image processing of an image displayed by a display apparatus, a clock signal generator generating a plurality of spread spectrum clocks, which area plurality of clock signals subjected to spread spectrum processing, and a transmitter transmitting a first spread spectrum clock, which is one of the plurality of spread spectrum clocks, to the first image processing circuit and a second spread spectrum clock, which is one of the plurality of spread spectrum clocks to the second image processing circuit. The clock signal generator includes a signal generator that generates a clock signal subjected to the spread spectrum processing and a signal divider that divides the clock signal into the plurality of spread spectrum clocks. The first and second image processing circuits synchronize with each other in accordance with the first and second spread spectrum clocks.

12 Claims, 11 Drawing Sheets

SUBSTRATE AND DISPLAY APPARATUS

BACKGROUND OF THE INVENTION

Field of the Invention

The present invention relates to a display apparatus and a substrate used for such a display apparatus, and more particularly, a circuit structure for countermeasures against unnecessary radiation.

Description of the Related Art

A high resolution display panel such as projectors, which performs parallel processing by a plurality of image processing blocks using a high speed operation clock to carry out a composition by one display panel drive circuit, has been used. Using the high speed operation clock and performing the parallel processing of data bases easily generate unnecessary radiation caused by EMI (Electromagnetic Interference). If spread spectrum processing is applied to operation clocks as countermeasures against unnecessary radiation, synchronization among a plurality of image processing blocks is very difficult in the structure driving one display panel using the plurality of the image processing blocks.

For example, as illustrated in FIG. 11A, when modulation characteristics of a spread spectrum in image processing circuits 102 and 103 are not synchronized with each other, differences of clock numbers in a horizontal synchronization signal between the image processing circuits occur. Moreover, as illustrated in FIG. 11B, since differences of clock numbers from each parallel processing block inputted into a display panel drive circuit 104 are large, a large scale FIFO (memory) is required to tolerate the differences of clock numbers.

Japanese Patent Laid-open No. 2008-216606 discloses a synchronization method to solve the above problem by synchronizing a modulation period of a spread spectrum with synchronization signals inputted from outside when spread spectrum processing is applied to operation clocks of an image processing circuit. Additionally, Japanese Patent Laid-open No. 2003-332997 discloses a demodulation method of clocks subjected to spread spectrum processing in respective processing circuit to strictly coincide with timing among the plurality of processing circuits.

However, the method disclosed in Japanese Patent Laid-open No. 2008-216606 may not synchronize among the plurality of image processing blocks (among image processing circuits). Furthermore, the method disclosed in Japanese Patent Laid-open No. 2003-332997 can synchronize among the plurality of image processing blocks, but since a spread spectrum in each image processing block (inside of the image processing circuit) is demodulated, an effect of countermeasures against unnecessary radiation drastically reduces.

SUMMARY OF THE INVENTION

The present invention provides a display apparatus and a substrate used for such a display apparatus capable of performing highly precise synchronization processing while reducing influence of unnecessary radiation when a plurality of image processing blocks are performed in parallel to drive one display element.

A substrate used for a display apparatus displaying an image according to one aspect of the present invention includes a first image processing circuit performing image processing of the image displayed by the display apparatus, a second image processing circuit performing image processing of the image displayed by the display apparatus, a clock signal generator generating a plurality of spread spectrum clocks, which area plurality of clock signals subjected to spread spectrum processing, and a transmitter transmitting a first spread spectrum clock, which is one of the plurality of spread spectrum clocks, to the first image processing circuit and a second spread spectrum clock, which is one of the plurality of spread spectrum clocks to the second image processing circuit. The clock signal generator includes a signal generator that generates a clock signal subjected to the spread spectrum processing and a signal divider that divides the clock signal into the plurality of spread spectrum clocks. The first and second image processing circuits synchronize with each other in accordance with the first and second spread spectrum clocks.

Further features and aspects of the present invention will become apparent from the following description of exemplary embodiments with reference to the attached drawings.

DESCRIPTION OF THE EMBODIMENTS

Exemplary embodiments of the present invention will be described below with reference to the accompanied drawings.

First Embodiment

Figure 1:
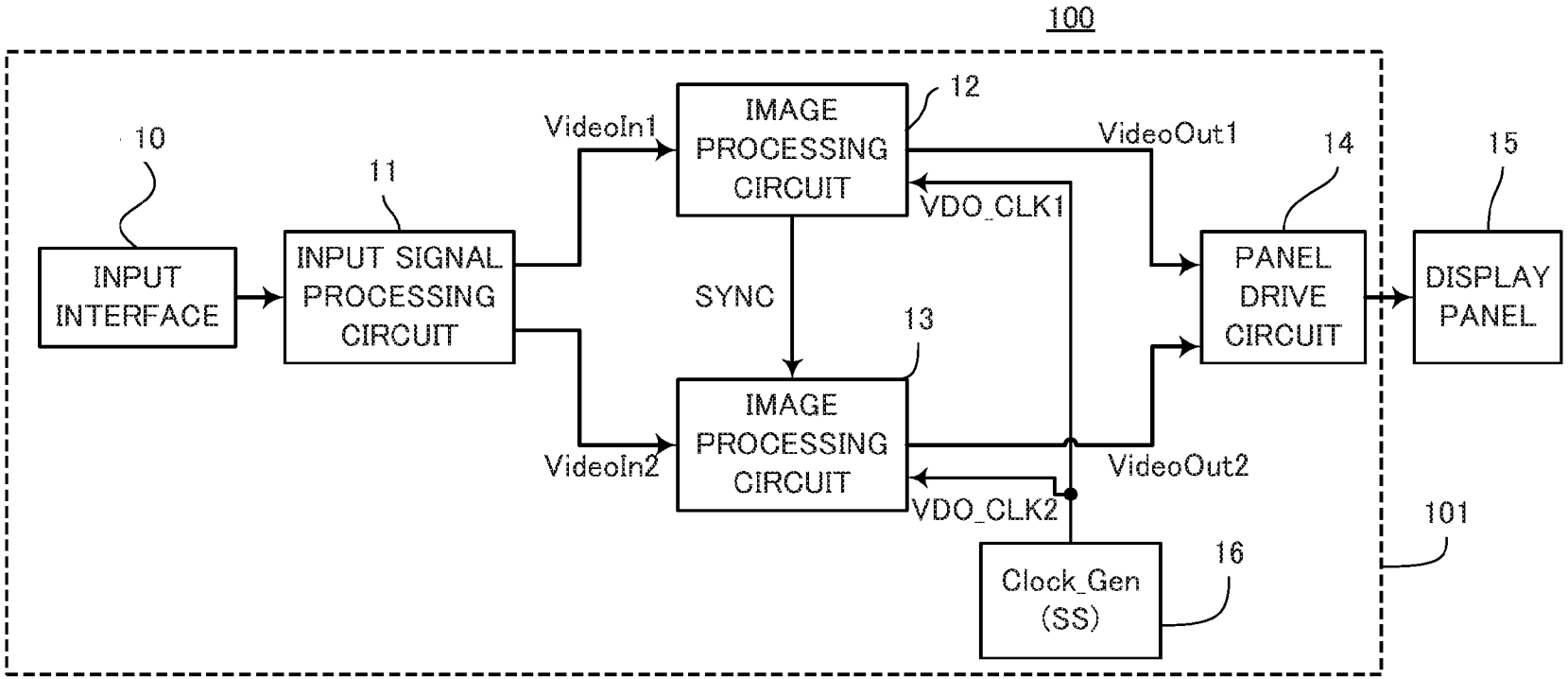
FIG. 1 is a block diagram illustrating a display apparatus according to a first embodiment of the present invention.

FIG. 1 is a structure of a display apparatus 100 according to a first embodiment, such as a projector and a liquid crystal display. Reference numeral 101 denotes a substrate used for the display apparatus 100. Reference numeral 10 denotes an input interface that is a video input terminal, such as an HDMI (High-Definition Multimedia Interface, registered trademark), a DVI (Digital Visual Interface), and a display port. A video signal from the input interface 10 subjected to decoding processing and switching processing by an input signal processing circuit 11 is divided into signals VideoIn1 and VideoIn2 to be respectively inputted to image processing circuits 12 and 13. Here, the image processing circuits 12 and 13 have the same structure and the same function. The image processing circuits 12 and 13 perform a serious of processing regarding image processing, such as resolution transformation processing, frame rate transformation processing, geometric transformation processing, color space transformation processing, panel drive system signal processing, and OSD composition/display processing.

Since data throughput becomes huge in high resolution image processing, signal processing is performed by dividing an area, for example, a left half of an image is processed by the image processing circuit 12 and aright half of the image is processed by the image processing circuit 13. Here, an example of parallel processing using two image processing circuits is exemplified, but the present invention is not limited to this and may perform parallel processing using four image processing circuits by dividing the image into four parts like an upper left part, a lower left part, an upper right part and a lower right part.

Moreover, the image processing circuits 12 and 13 synchronize with each other in accordance with a synchronization signal SYNC. The synchronization signal SYNC is, for example, a signal corresponding to a horizontal synchronization signal and a vertical synchronization signal, and synchronizes a panel video signal VideoOut1 output from the image processing circuit 12 and a panel video signal VidepOut2 output from the image processing circuit 13 at a VDO_CLK rate. In fact, one of the image processing circuits generates a synchronization signal as an output master, and the other of the image processing circuits receives the synchronization signal and synchronizes with the synchronization signal as an input slave. FIG. 1 illustrates the structure that transmits the synchronization signal SYNC from the image processing circuit 12 to the image processing circuit 13, but the present invention may be the structure that transmits the synchronization signal SYNC from the image processing circuit 13 to the image processing circuit 12.

The panel video signals VideoOut1 and VideoOut2 processed by the image processing circuits 12 and 13 is inputted into a panel drive circuit (display drive circuit) 14. The panel drive circuit 14 synchronizes the panel video signals VideoOut1 and VideoOut2 inputted from two lines of the image processing circuits 12 and 13, performs conversion processing converting to data appropriate for a drive of a display panel 15, and generates a drive timing signal.

Reference numeral 16 is a clock generator that includes a clock generating circuit (signal generator) 20 having a phase synchronization circuit (PLL: Phase Locked Loop) and a spread spectrum circuit (SS). The clock generator 16 outputs one line of a clock signal (spread spectrum clock) subjected to spread spectrum processing that is one of countermeasures of EMI.

The clock signal output from the clock generator 16 is branched (divided) by a Point_c (signal divider) as described below, and the divided signals are respectively inputted into inputters of the image processing circuits 12 and 13 through wirings (transmitter) 19*a* and 19*b*. In other words, in this embodiment, the clock generator 16 and the Point_c work as a clock signal generating apparatus (clock signal generator) 40 generating a plurality of clock signals (first spread spectrum clock and second spread spectrum clock).

The image processing circuits 12 and 13 output the panel video signals (image signals) VideoOut1 and VideoOut2 in synchronization with the inputted clock signal. This clock connection needs a predetermined restriction and will be detailed later.

Figure 2:
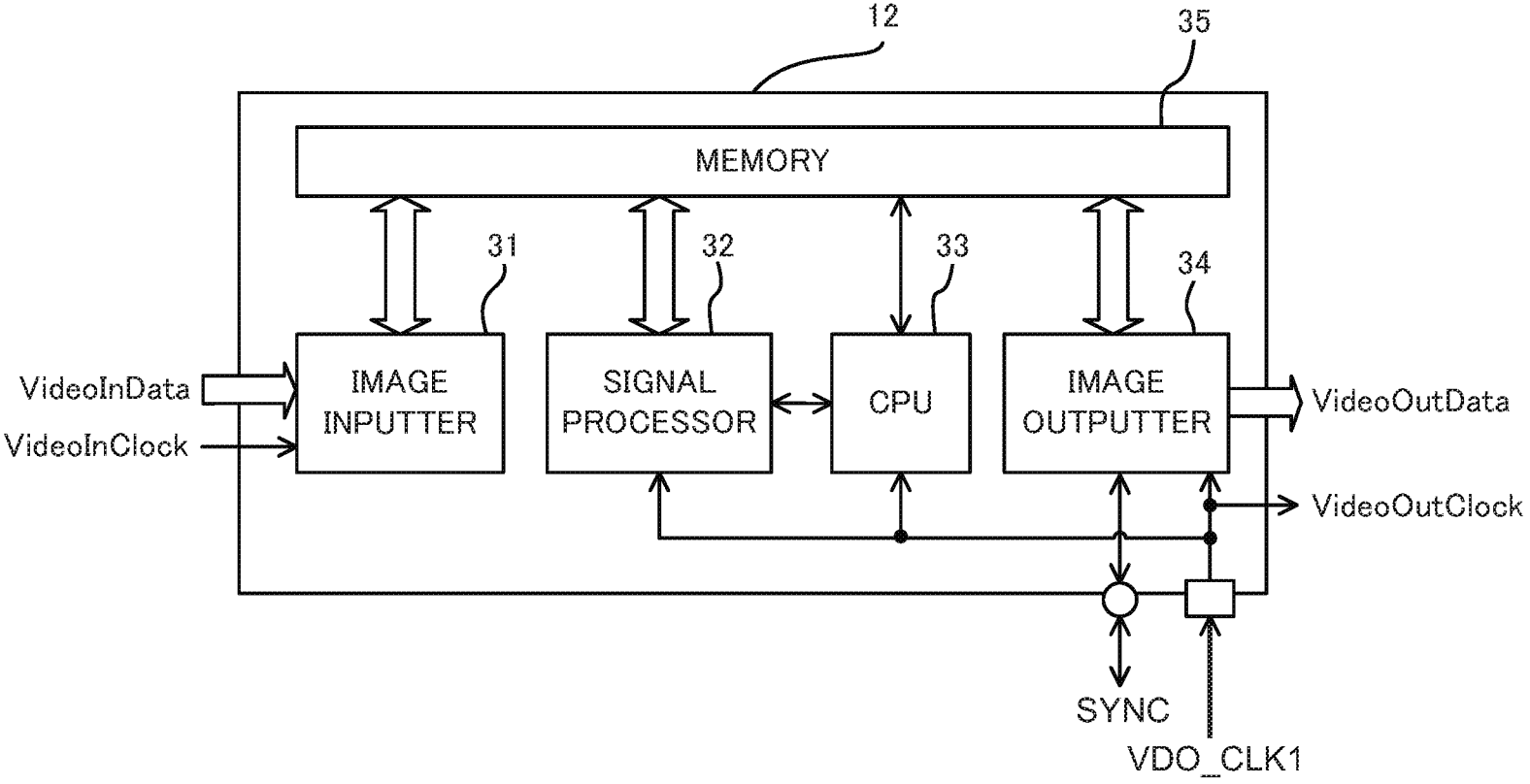
FIG. 2 is a block diagram illustrating an image processing circuit according to the first embodiment.

Next, the image processing circuits 12 and 13 will be explained in detail with reference to FIG. 2. FIG. 2 illustrates an inside of the image processing circuit 12.

An image inputter 31 receives an input image clock VideoInClock and input image data VideoInData synchronous with the input image clock VideoInClock, and stores these signals in a memory 35. A signal processor reads out the image data from the memory 35 in synchronization with a display panel drive clock VDO_CLK1, applies the previously mentioned image processing on the image data, and stores the processed image data in the memory 35. An image outputter 34 reads out the image data from the memory 35 in synchronization with the display panel drive clock VDO_CLK1, converts the image data to suit a display panel drive, and generates a drive synchronization signal. According to such a structure, the image processing circuit 12 outputs output image data VideoOutData. The image processing circuit 12 also outputs an output image clock VideoOutClock that is identical with the display panel drive clock VDO_CLK1 or is synchronized with the display panel drive clock VDO_CLK1. A CPU (Central Processing Unit) 33 controls each function of the image inputter 31, the signal processor 32, and the image outputter 34. The CPU 33, for example, operates at a clock identical with the display panel drive clock VDO_CLK1.

An inside of the image processing circuit 13, which is not illustrated, has the same structure as the image processing circuit 12. Then, input of the display panel drive clock VDO_CLK1 is replaced with input of a display panel drive clock VDO_CLK2.

Figure 3:
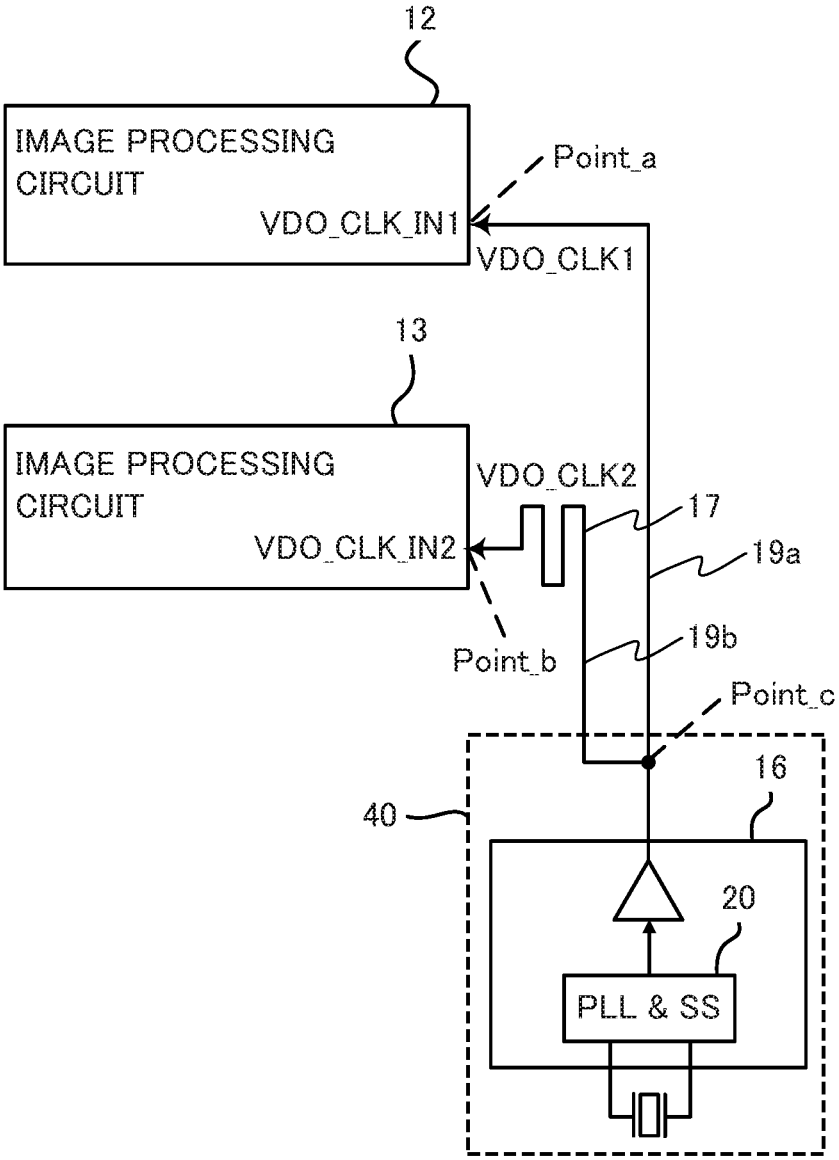
FIG. 3 is a schematic diagram illustrating an example of wiring of a clock supply according to the first embodiment.

Next, a timing restriction of the previously mentioned clock will be explained with reference to FIG. 3. FIG. 3 is a wiring diagram illustrating a specific example of a wiring restriction of the clock. Point_a is an input terminal VDO_CLK_IN1 of the image processing circuit 12. Point_b is an input terminal VDO_CLK_IN2 of the image processing circuit 13. The Point_c (signal divider) is a branch point dividing output from one terminal of the clock generator 16 into output to the image processing circuit 12 and output to the image processing circuit 13.

Here, when a length of the wiring 19*a* between the Point_a and the Point_c is WL1 and a length of the wiring 19*b* between the Point_b and the Point_c is WL2, a length of the wirings are set to satisfy the following expression (1).

$$WL1=WL2 \tag{1}$$

In the example of FIG. 3, a physical length from the input terminal VDO_CLK_IN2 of the image processing circuit 13 to an outputter of the clock generator 16 is shorter than a physical length from the input terminal VDO_CLK_IN1 of the image processing circuit 12 to the outputter of the clock generator 16. Accordingly, in this embodiment, the length of the wiring 19*b*, which transmits the display panel drive clock VDO_CLK2, is adjusted by applying the wiring 19*b* to meander wiring 17 (delayer, phase difference adjuster) treated with meander processing, and transmission time between the Point_b and the Point_c is delayed.

This structure can input one output of the clock signal subjected to the spread spectrum processing to the image processing circuits 12 and 13, and can precisely perform synchronization processing while reducing unnecessary radiation. Thus, deterioration of waveform quality by a reflection can be prevented. Additionally, adjusting the wiring length to satisfy the expression (1) can equalize transmission time of the clock signals from the Point_c to the input terminals of the image processing circuits, and can decrease phase differences between phases inputted into the image processing circuits 12 and 13. In other words, clocks having the same phase can be inputted to the Point_a and Point_b.

Figure 4:
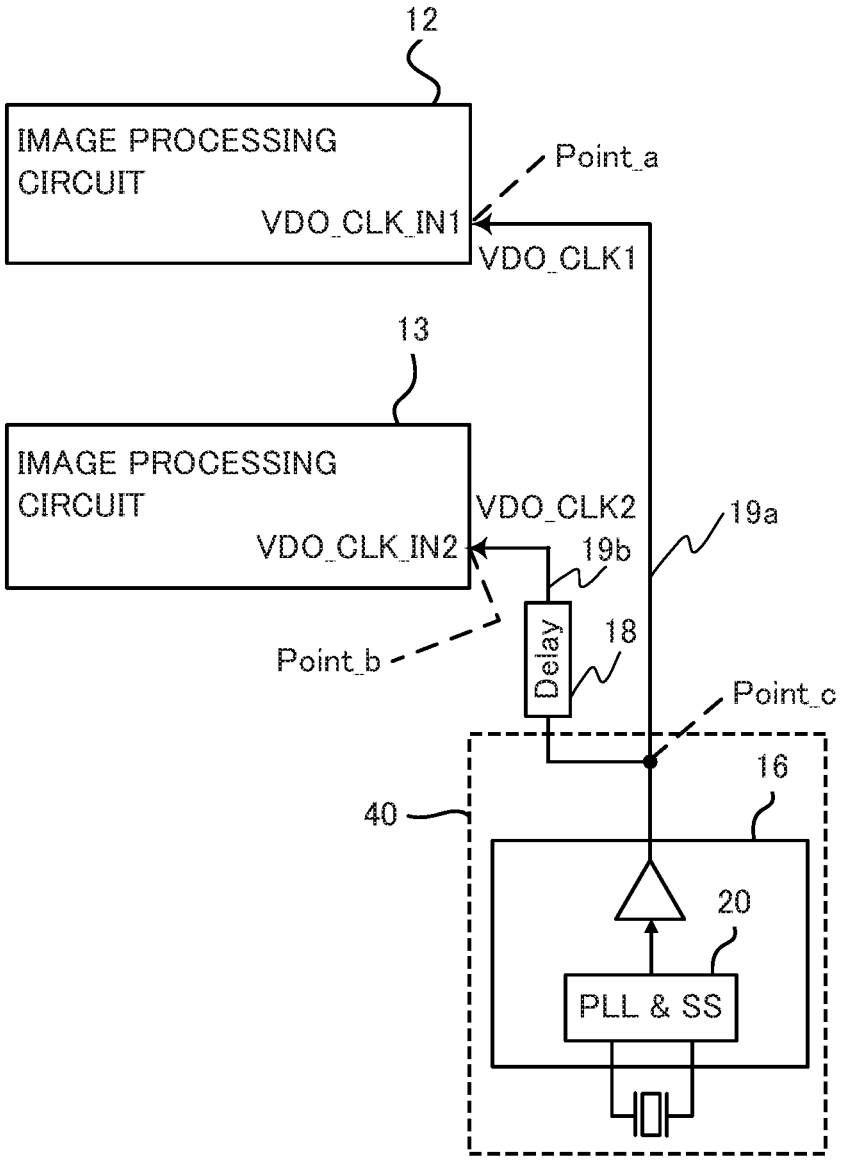
FIG. 4 is a schematic diagram illustrating another example of wiring supply of a clock supply according to the first embodiment.

Moreover, clocks having the same phase are inputted to the Point_a and Point_b using the meander wiring 17 in FIG. 3, but a delay element (delayer, phase difference adjuster) 18 may be inserted in the wiring 19*b* as illustrated in FIG. 4. Inserting the delay element 18 delays transmission time of the display panel drive clock VDO_CLK2 and can adjust phases inputted into the image processing circuits similar to the case the length of the wiring 19*b* is lengthened. A passive element, such as resistor and a filter, is used as the delay element 18.

As stated above, the present invention divides (branches) a signal from one clock source subjected to the spread spectrum processing and provides the plurality of image processing circuits with the divided signals so as to easily perform synchronization on the basis of spread spectrum clocks among the plurality of image processing circuits. Besides, since demodulation of the spread spectrum clocks is not performed, influence of unnecessary radiation can be reduced by the effect of the spread spectrum processing in transmission between the image processing circuit and the panel drive circuit.

Second Embodiment

Figure 5:
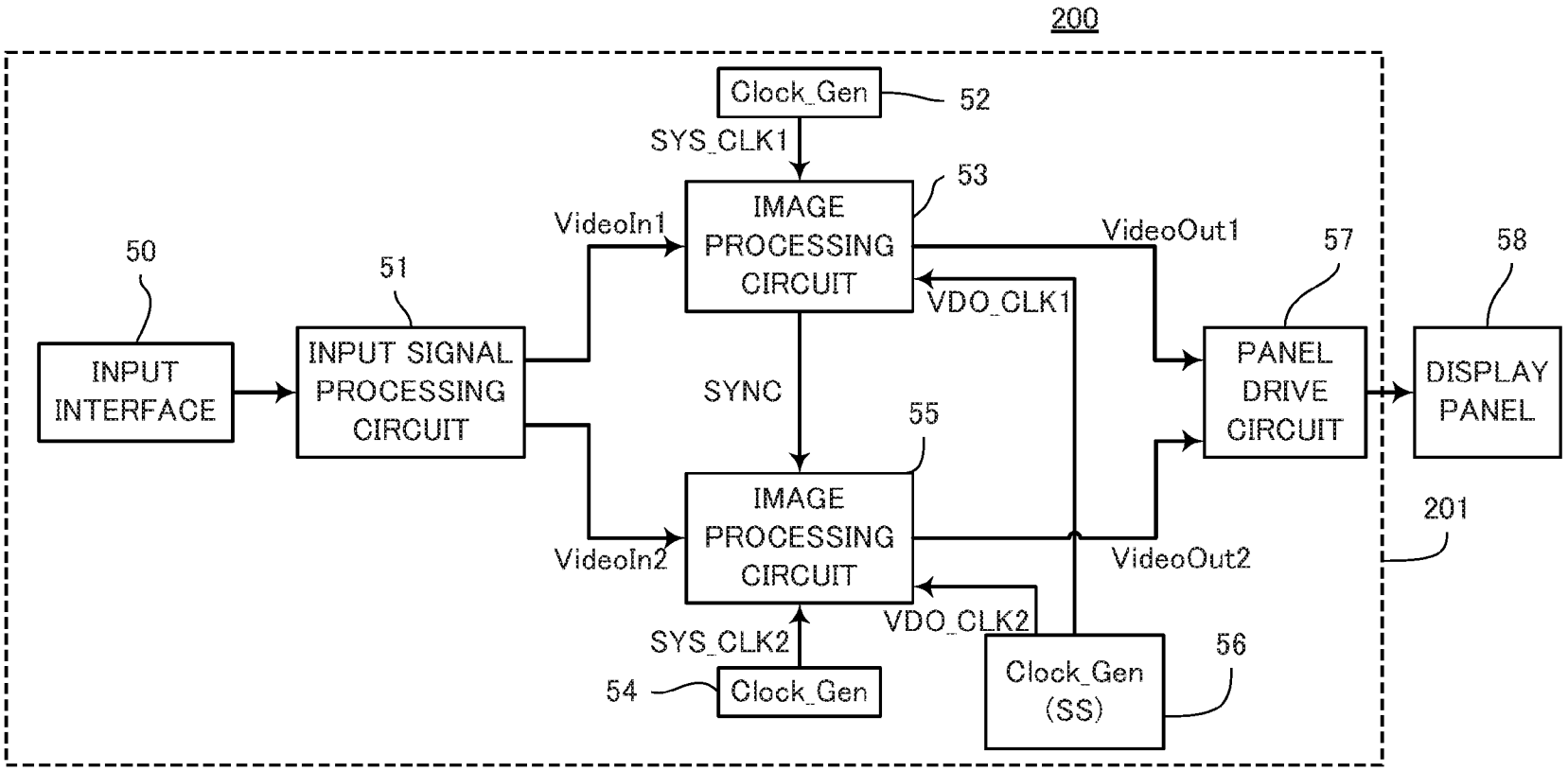
FIG. 5 is a block diagram illustrating a display apparatus according to a second embodiment of the present invention.

FIG. 5 illustrates a display apparatus 200 according to a second embodiment and a substrate 201 used for the display apparatus 200. A flow of a signal and components of this embodiment are mostly the same as the first embodiment. Examinations regarding overlapping substructure are omitted. This embodiment differs from the first embodiment in the following two points.

First, a display panel drive clock and a system clock for internal processing are different lines. Clock generators 52 and 54 are respectively connected to image processing circuits 53 and 55 as a system clock.

Second, a clock generating apparatus (clock signal generator) 56 subjected to spread spectrum processing as a display panel drive clock source includes two clock outputs (outputter), which are synchronized with each other. The two clock outputs of the clock display apparatus 56 are respectively connected to display panel drive clock inputs of the two image processing circuits 53 and 55. This clock connection needs a predetermined restriction and will be detailed later.

Figure 6:
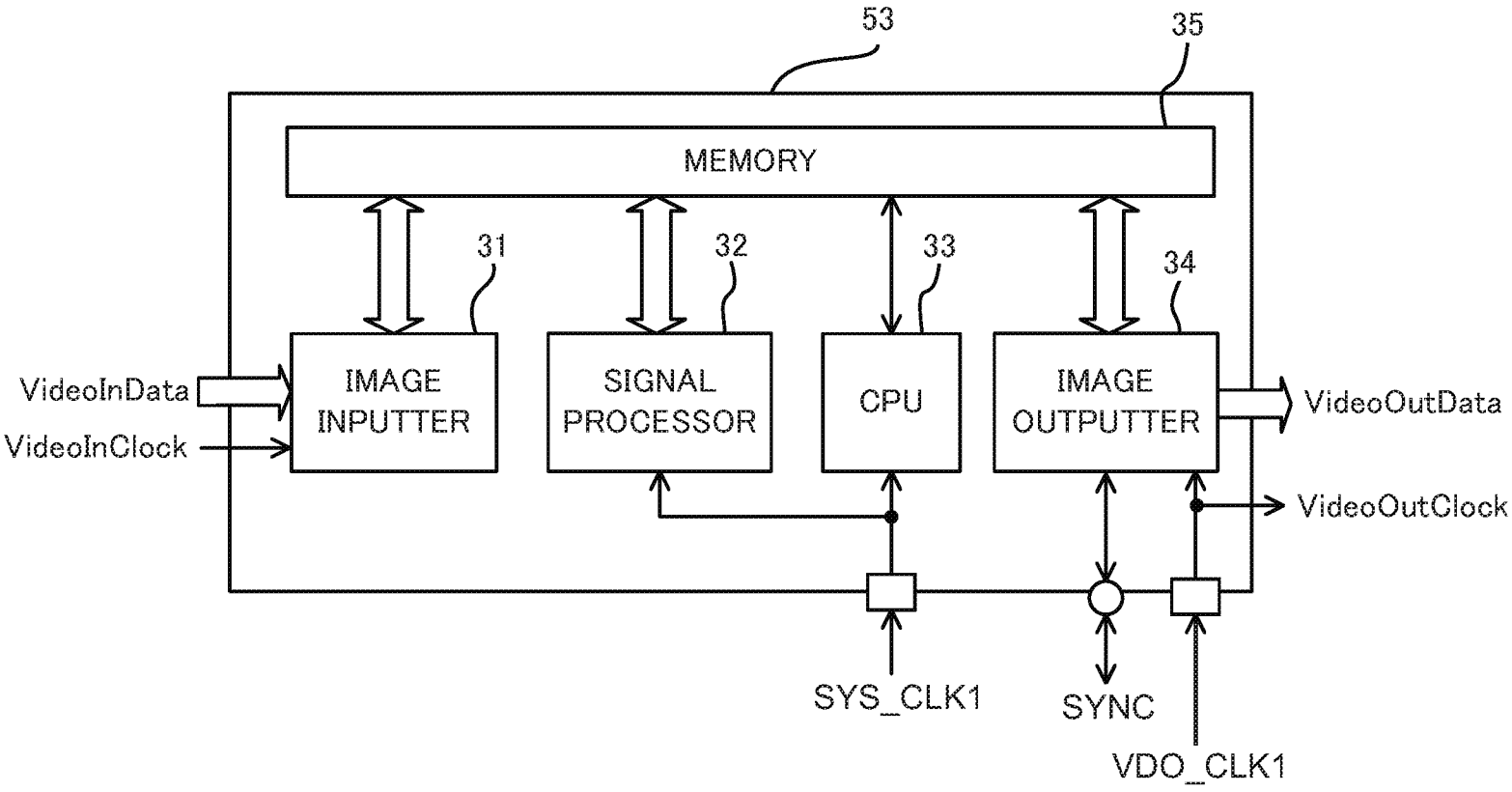
FIG. 6 is a block diagram illustrating an image processing circuit according to the second embodiment.

Next, the image processing circuits 53 and 55 will be explained in detail with reference to FIG. 6. FIG. 6 illustrates an inside of the image processing circuit 53.

Unlike the first embodiment, since the two clock systems exist, a display panel drive clock VDO_CLK1 and an internal processing signal SYS_CLK1 are separately inputted into each image processing circuit. The display panel drive clock VDO_CLK1 becomes an operation reference clock of the image outputter 34 and the output image clock VideoOutClock. Meanwhile, the internal processing clock SYS_CLK1 becomes an operation reference clock of the signal processor 32 and the CPU 33. Limitation of internal processing speed is determined, for example, by memory bus speed. Accordingly, the internal processing clock is preferably set independently from the output image clock VideoOutClock and the input image clock VideoInClock. Separating a clock line is commonly performed.

An inside of the image processing circuit 55, which is not illustrated, also has the same structure as the image processing circuit 53. Then, input of the display panel drive clock VDO_CLK1 is replaced with input of a display panel drive clock VDO_CLK2, and the internal processing clock SYS_CLK1 is replaced with an internal processing clock SYS_CLK2.

The internal processing clocks SYS_CLK1 and SYS_CLK2 are clock lines confined inside of the image processing circuits 53 and 55, and thus synchronization need not be mutually performed between the image processing circuits 53 and 55. Additionally, on/off of the spread spectrum processing can be independently set.

Figure 8A:
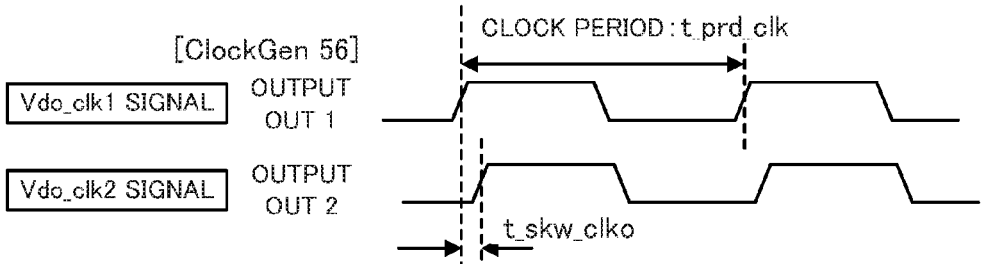
FIGS. 8A to 8C are timing charts among image processing circuits according to the second embodiment.
Figure 8B:
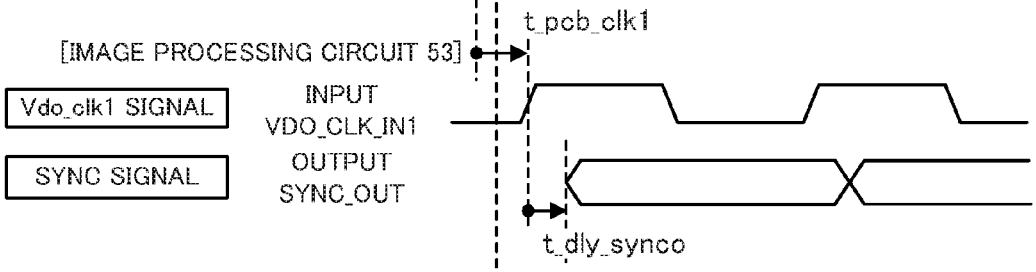
Figure 8C:
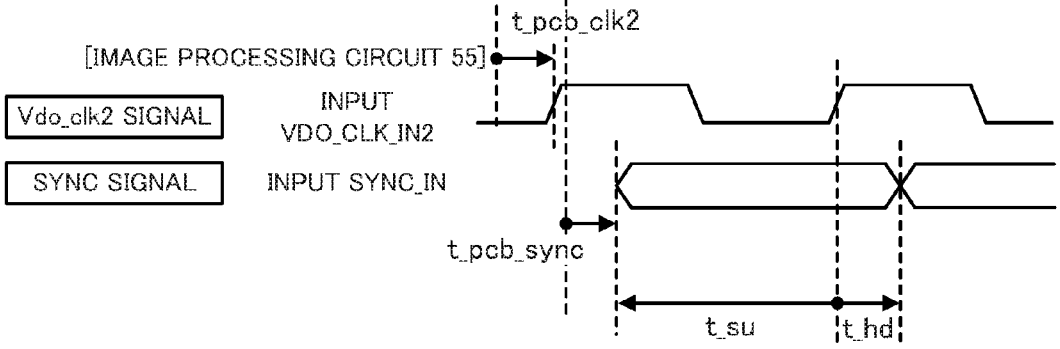

Next, the previously mentioned clock restriction will be specifically explained with reference to FIGS. 8A to 8C. FIGS. 8A to 8C are timing charts illustrating timing relations among output from the clock generating apparatus 56, clocks regarding the image processing circuits 53 and 55, and a synchronization signal SYNC.

FIG. 8A illustrates timing of two output terminals of the clock generating apparatus 56. In FIG. 8A, output from the terminal OUT2 has skew amounts t_skw_clko [ns] with respect to output from the terminal OUT1.

FIG. 8B illustrates the display panel drive clock VDO_CLK1 at an input terminal VDO_CLK_IN1 and the synchronization signal SYNC at an output terminal SYNC_OUT in the image processing circuit 53. The display panel drive clock VDO_CLK1 reaches the input terminal VDO_CLK_IN1 from the terminal OUT1 of the clock generating apparatus 56 in transmission time (a wiring delay on the substrate) t_pcb_clk1 [ns]. The synchronization signal SYCN is output after t_dly_synco [ns] from time where the display panel drive clock VDO_CLK1 reaches the input terminal VDO_CLK_IN1.

FIG. 8C illustrates the display panel drive clock VDO_CLK2 at an input terminal VDO_CLK_IN2 and the synchronization signal SYNV at an input terminal SYNC_IN in the image processing circuit 55. The display panel drive clock VDO_CLK2 output from the terminal OUT2 of the clock generating apparatus (clock signal generator) reaches the input terminal VDO_CLK_IN2 in transmission time t_pcb_clk2 [ns]. Meanwhile, the synchronization signal SYNC output from the output terminal SYNC_OUT of the image processing circuit 53 reaches the input terminal SYNC_IN in transmission time t_pcb_sync [ns].

Here, regarding timing for taking in the synchronization signal SYNC in the image processing circuit 55, hold time t_hd and setup time t_su are respectively represented by the following expressions (2) and (3).

$$t_hd=(t_pcb_clk1-t_pcb_clk2)+t_dly_synco+t_pcb_sync-t_skw_clko \quad (2)$$

$$t_su=t_prd_clk-(t_pcb_clk1-t_pcb_clk2)-t_dly_synco-t_pcb_sync+t_skw_clko \quad (3)$$

Additionally, t_su_min and t_hd_min respectively denote minimum setup time and minimum hold time of the image processing circuit 55. Then, a timing margin of the setup time t_su_margin and a timing margin of the hold time t_hd_margin are respectively represented by expressions (4) and (5).

$$t_hd_\mathrm{margin}=t_hd_\mathrm{min}-t_hd=t_hd_\mathrm{min}-(t_pcb_clk1-t_pcb_clk2)-t_dly_synco-t_pcb_sync+t_skw_clko \quad (4)$$

$$t_su_\mathrm{margin}=t_su_\mathrm{min}-t_su=t_su_\mathrm{min}-t_prd_clk+(t_pcb_clk1-t_pcb_clk2)+t_dly_synco+t_pcb_sync-t_skw_clko \quad (5)$$

Ideally, the timing margin of the setup time is equal to the timing margin of the hold time (the timing margin is maximum). Thus, in the expressions (4) and (5), wiring delay amounts on the substrate, in other words transmission time t_pcb_clk1, t_pcb_clk2, and t_pcb_sync are adjusted so that the timing margin of the hold time t_hd_margin is approximately equal to the timing margin of the setup time t_su_margin.

Figure 7:
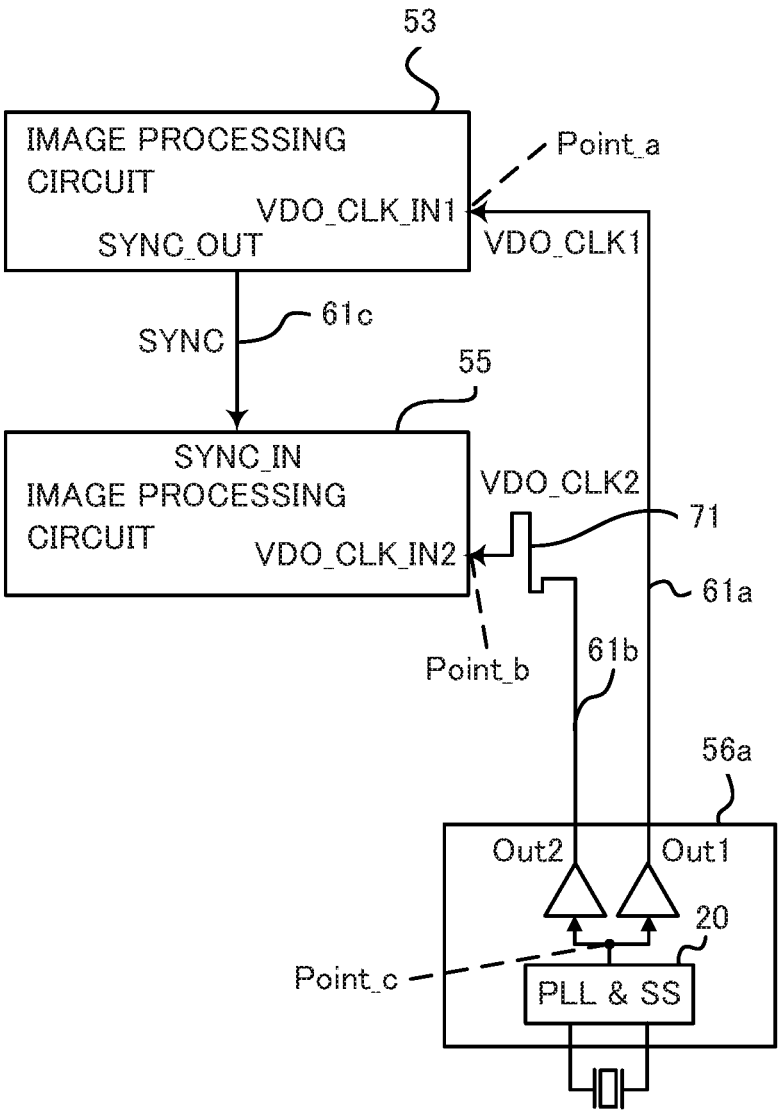
FIG. 7 is a schematic diagram illustrating an example of wiring of a clock supply according to the second embodiment.

Here, in the structure of FIG. 7, lengthening a length of a wiring 61*b*, which transmits the display panel drive clock VDO_CLK2 output from the clock generating apparatus 56*a*, using meander wiring (delayer, phase difference adjuster) 71 as with FIG. 3 adjusts transmission time (wiring delay amounts).

WL1 denotes a length of a wiring 61*a* transmitting the display panel drive clock VDO_CLK1, WL2 denotes a length of the wiring 61*b* transmitting the display panel drive clock VDO_CLK2, and WL3 denotes a length of a wiring 61*c* transmitting the synchronization signal SYNC. Then, when transmission time (delay time) per unit length on the wiring is 7 [ps/mm], differences AWL between the lengths WL1 and WL2 where the timing margin is maximum is represented by the following expression (6).

$$\Delta WL = WL1 - WL2 = \Delta t_pcb_clk/7\ [ps/mm] = (t_hd_min - t_su_min + t_prd_clk)/14 + (t_skw_clko - t_dly_synco)/7 + WL3 \quad (6)$$

Δt_pcb_clk denotes differences the transmission time t_pcb_clk1 and the transmission time t_pcb_clk2.

In other words, in the structure of FIG. 7, adjusting the length WL2 to be a length calculated from the expression (6) using the meander wiring 71 can adjust phase differences of phases inputted into the image processing circuits 53 and 55, and can secure the timing margin. Thus, the timing margin can be maximized or the expressions (4) and (5) can satisfy the timing restriction of the image processing circuit 55.

Figure 9:
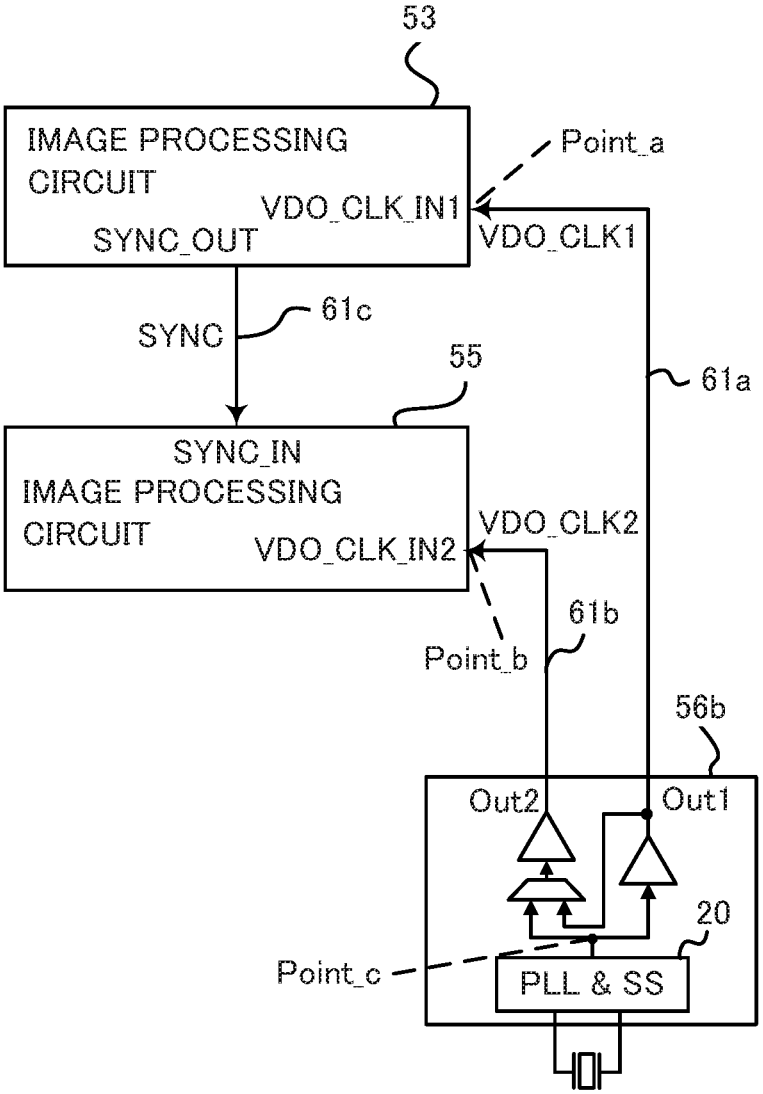
FIG. 9 is a schematic diagram illustrating another example of wiring supply of a clock supply according to the second embodiment.

Moreover, FIG. 9 illustrates a structure to secure the time margin by a method different from the method explained using FIG. 7. A signal utilizing (combining) a signal immediately before outputting from the terminal OUT1 is output from the terminal OUT2 of the clock generating apparatus 56*b*. Accordingly, the phase of the signal output from the terminal OUT2 certainly delays compared to the phase of the signal output from the terminal OUT1. In this case, the wiring 61*a*, which transmits the display panel drive clock VDO_CLK1, and the wiring 61*b*, which transmits the display panel drive clock VDO_CLK2, are respectively connected to the terminals OUT1 and OUT2, and the skew amounts t_skw_clko [ns] are adjusted. This wiring circuit (phase difference adjuster) can adjust phase differences between phases inputted into the image processing circuit 53 and 55, and thus the timing margin can be maximized or the expressions (4) and (5) can satisfy the timing restriction of the image processing circuit 55.

Figure 10:
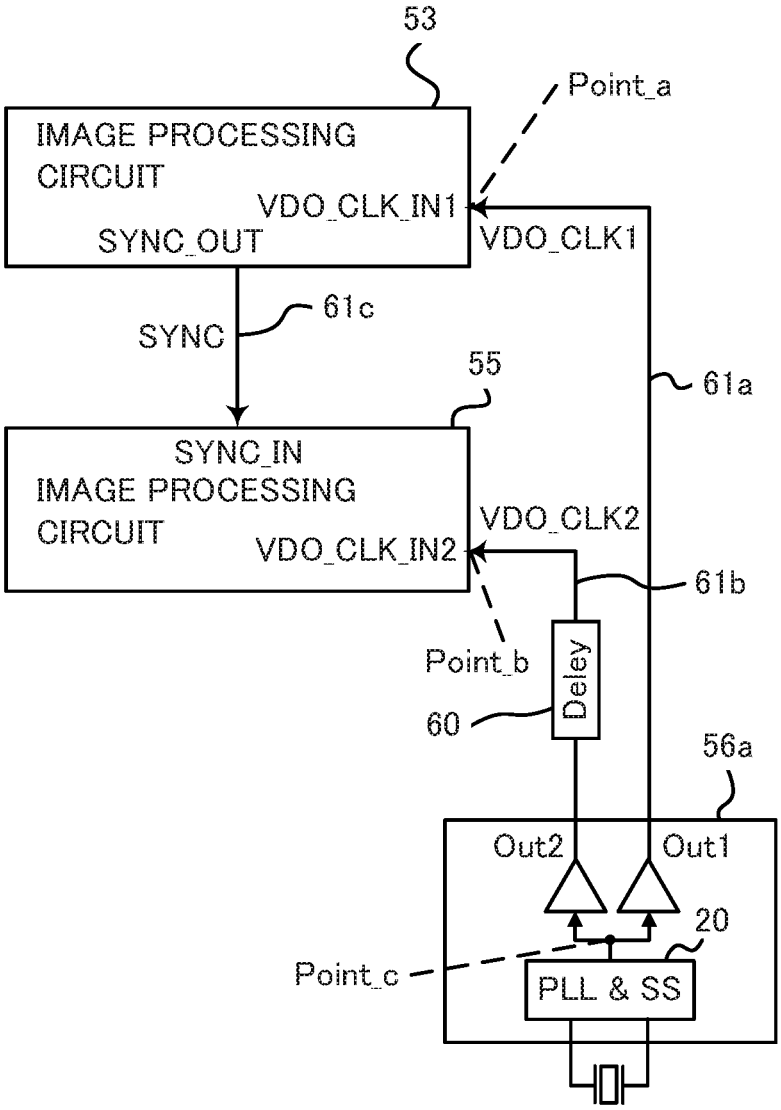
FIG. 10 is a schematic diagram illustrating still another example of wiring supply of a clock supply according to the second embodiment.
Figure 11A:
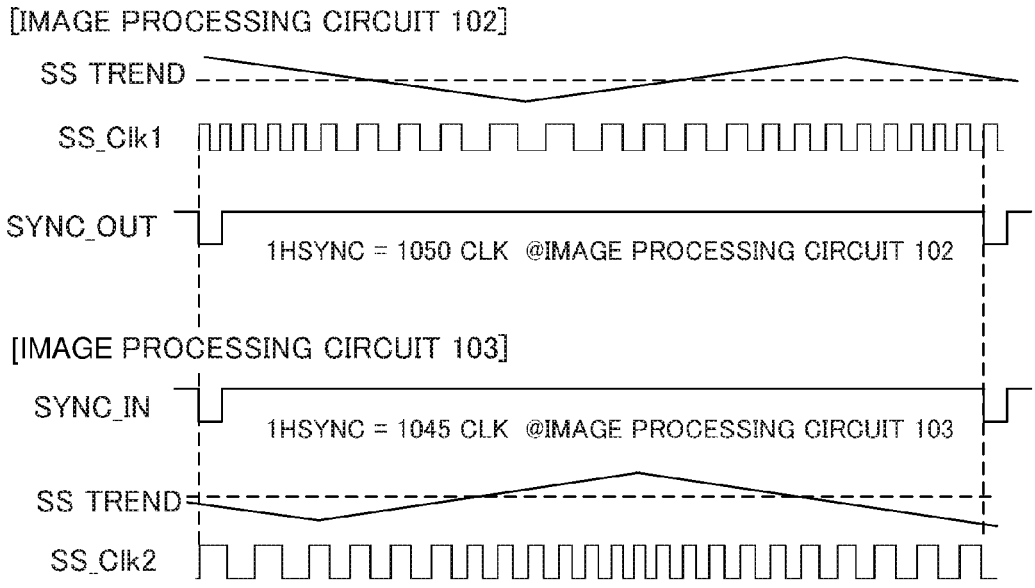
FIG. 11A (PRIOR ART)
FIGS. 11A and 11B are explanatory diagrams illustrating problems occurring when spread spectrum processing is not performed.
Figure 11B:
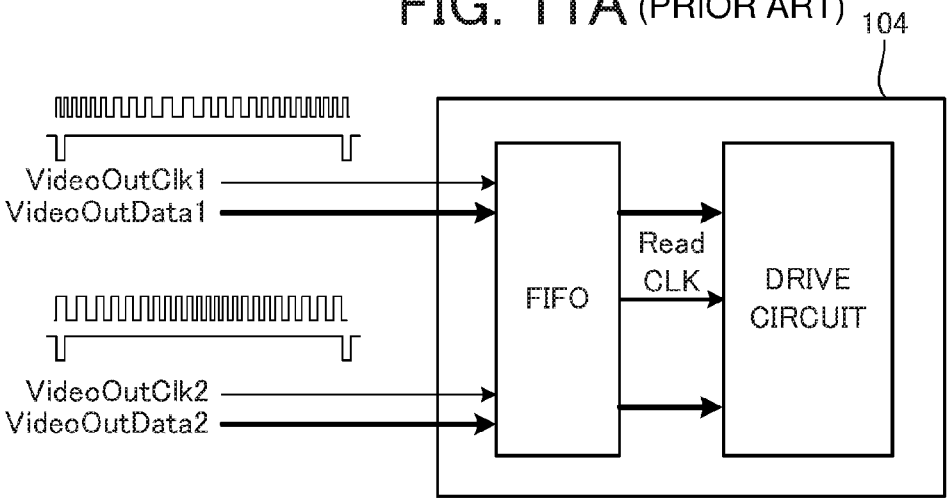
FIG. 11B (PRIOR ART)

Besides, FIG. 10 illustrates a structure to secure a timing margin by a method different from the methods explained using FIGS. 7 and 9. The clock generating apparatus 56*a* is the same structure as that of FIG. 7. A delay element (delayer, phase difference adjuster) 60 is inserted in the wiring 61*b*. Inserting the delay element 60 delays transmission time of the display panel drive clock VDO_CLK2 and can adjust phase differences between phases inputted into the image processing circuits 53 and 55 similar to the case the length of the wiring 61*b* is lengthened. As a result, the timing margin can be maximized or the expressions (4) and (5) can satisfy the timing restriction of the image processing circuit 55. A passive element, such as resistor and a filter, is used as the delay element.

As stated above, the present invention divides (branches) a signal from one clock source subjected to the spread spectrum processing to supply the divided signal to the plurality of image processing circuits, and thus can provides the spread spectrum clocks (the clock signals subjected to the spread spectrum processing) synchronizing with each other. Then, with this substructure of this embodiment, performing wiring in view of synchronization between the image processing circuits using the synchronization signal SYNC keeps timing restriction. Thus, synchronization of output timing among the plurality of the image processing circuits is secured without demodulating the spread spectrum clocks, and the effect of the spread spectrum processing can reduce influence of unnecessary radiation in transmission between the image processing circuit and the panel drive circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107066, filed on May 27, 2015, which is hereby incorporated by reference herein in its entirety.

What is claimed is:

1. A substrate used for a display apparatus that displays an image, comprising:

a first image processing circuit configured to perform image processing of the image displayed by the display apparatus;

a second image processing circuit configured to perform image processing of the image displayed by the display apparatus;

a clock signal generator configured to generate a plurality of spread spectrum clocks, which are a plurality of clock signals subjected to spread spectrum processing;

a transmitter configured to transmit a first spread spectrum clock, which is one of the plurality of spread spectrum clocks, to the first image processing circuit and a second spread spectrum clock, which is another one of the plurality of spread spectrum clocks, to the second image processing circuit; and a phase difference adjuster configured to adjust a phase difference between the first and second spread spectrum clocks, wherein the clock signal generator includes a signal generator that generates a clock signal subjected to the spread spectrum processing and a signal divider that divides the clock signal subjected to the spread spectrum processing into the plurality of spread spectrum clocks, and wherein the first and second image processing circuits synchronize with each other in accordance with the first and second spread spectrum clocks.

2. The substrate according to claim 1, wherein the transmitter includes the phase difference adjuster.

3. The substrate according to claim 1, wherein the transmitter includes a delayer configured to delay transmission time of the first spread spectrum clock from the signal divider to the first image processing circuit or transmission time of the second spread spectrum clock from the signal divider to the second image processing circuit.

4. The substrate according to claim 3, wherein the delayer includes meander wiring.

5. The substrate according to claim 1, wherein the first image processing circuit transmits a synchronization signal synchronized with the first spread spectrum clock to the second image processing circuit, and wherein the phase difference adjuster adjusts the phase difference on the basis of transmission time of the synchronization signal from the first image processing circuit to the second image processing circuit.

6. The substrate according to claim 5, wherein the transmitter adjusts the phase difference to maximize a time margin for taking in the synchronization signal by the second spread spectrum clock inputted into the second image processing circuit.

7. The substrate according to claim 5, wherein the second image processing circuit outputs an image signal on the basis of the second spread spectrum clock and the synchronization signal.

8. The substrate according to claim 1, wherein output timing of respective image signals output from the first and second image processing circuits synchronizes with each other.

9. The substrate according to claim 1, further comprising a display drive circuit configured to drive the display apparatus, wherein the first and second image processing circuits respectively output an image signal synchronized with the clock signal subjected to the spread spectrum processing to the display drive circuit.

10. The substrate according to claim 1, wherein the first image processing circuit transmits a synchronization signal synchronized with the first spread spectrum clock to the second image processing circuit, and wherein the second image processing circuit outputs an image signal on the basis of the second spread spectrum clock and the synchronization signal.

11. The substrate according to claim 1, wherein the first image processing circuit operates at least a first clock for internal processing and the first spread spectrum clock to output an image signal, and wherein the second image processing circuit operates at least a second clock for internal processing and the second spread spectrum clock to output an image signal.

12. A display apparatus comprising:

a substrate;

a displayer configured to display an image on the basis of an image signal output from the substrate, wherein the substrate includes a first image processing circuit configured to perform image processing of the image displayed by the displayer, a second image processing circuit configured to perform image processing of the image displayed by the displayer, a clock signal generator configured to generate a plurality of spread spectrum clocks, which are a plurality of clock signals subjected to spread spectrum processing, a transmitter configured to transmit a first spread spectrum clock, which is one of the plurality of spread spectrum clocks, to the first image processing circuit and a second spread spectrum clock, which is another one of the plurality of spread spectrum clocks, to the second image processing circuit, a phase difference adjuster configured to adjust a phase difference between the first and second spread spectrum clocks, and a display drive circuit configured to drive the displayer, wherein the clock signal generator includes a signal generator that generates a clock signal subjected to the spread spectrum processing and a signal divider that divides the clock signal subjected to the spread spectrum processing into the plurality of spread spectrum clocks, and wherein the first and second image processing circuits synchronize with each other in accordance with the first and second spread spectrum clocks, and wherein the first and second image processing circuits respectively output the image signal synchronized with the clock signal subjected to the spread spectrum processing to the display drive circuit.

* * * * *